United States Patent [19]

Allen et al.

[11] 3,975,219

[45] Aug. 17, 1976

[54] THERMOMECHANICAL TREATMENT FOR NICKEL BASE SUPERALLOYS

[75] Inventors: Marvin Martin Allen, W. Palm Beach; John Alois Miller, Lake Park, both of Fla.; Bruce Edward Woodings, Houston, Tex.

[73] Assignee: United Technologies Corporation, Hartford, Conn.

[22] Filed: Sept. 2, 1975

[21] Appl. No.: 609,861

[52] U.S. Cl. ..... 148/11.5 P; 148/11.5 N; 148/32

[51] Int. Cl.[2] ..... C22D 1/10

[58] Field of Search ..... 148/11.5 F, 11.5 P, 148/11.5 N, 32

[56] References Cited

UNITED STATES PATENTS

| | | | |
|---|---|---|---|
| 3,519,419 | 7/1970 | Gibson et al. | 148/12.7 N |
| 3,850,702 | 11/1974 | Buchanan | 148/11.5 P |
| 3,702,791 | 11/1972 | Freche et al. | 148/11.5 P |
| 3,772,090 | 11/1973 | Allen et al. | 148/32 |
| 3,825,420 | 7/1974 | Ewing et al. | 148/32 |
| 3,920,489 | 11/1975 | Buchanan | 148/32 |

*Primary Examiner*—W. Stallard

*Attorney, Agent, or Firm*—Charles E. Sohl

[57] ABSTRACT

A thermomechanical treatment for producing useful microstructures in the nickel base superalloys is described. The process is applied to material which has been placed in a condition of super-plasticity, and utilizes isothermal hot deformation under conditions which produce a uniform dislocation density and a resultant propensity for abnormal grain growth. The material is then recrystallized in a thermal gradient to produce a final structure consisting of elongated grains.

4 Claims, 8 Drawing Figures

MAG = 3/4 X

MAG = 1 1/2 X

THERMOMECHANICAL TREATMENT FOR NICKEL BASE SUPERALLOYS

BACKGROUND OF THE INVENTION

1. Field of the Invention

This invention deals with the production of nickel base superalloy articles having an anisotropic elongated grain structure suited for use at elevated temperatures. A thermomechanical treatment is used on super-plastic materials in the solid state, followed by annealing using a thermal gradient.

2. Description of the Prior Art

The mechanical properties of metals are strongly affected by grain boundaries. At low temperatures, grain boundaries are generally stronger than the material within the grains, but at high temperatures the reverse is true. At elevated temperatures, creep is usually observed to occur much more rapidly in fine grain materials than coarse grain materials. For this reason, coarse grained materials are usually preferred for stressed applications at elevated temperature.

Improvements in creep properties of coarse grain materials may be obtained if the grains can be significantly elongated in the direction of stress. This elongated grain material has significantly fewer grain boundaries transverse to the stress axis and accordingly has improved high temperature properties in the direction of grain elongation. As used herein, the term "elongated grain" is intended to encompass single crystal material, which are those characterized by the absenece of internal grain boundaries.

Two general techniques exist for producing such maaterial. One method, known as directional solidification (D.S.) involves controlling the heat flow and other conditions during the solidification process to produce an elongated microstructure. This technique is discussed in U.S. Pat. No. 3,260,505 issued to VerSnyder in 1964 of common assignee with the present application. The process described in this prior patent produces elongated grains in a cast structure.

The second method involves controlled recrystallization after deformation. In its best known form, this type of process involves straining the material a small, but critical amount, to produce a particular dislocation density, and then heating to above the recrystallization temperature under conditions which encourage grain growth rather than grain nucleation. This process produces elongated grains in a wrought type of structure. The heating is usually performed in a moving thermal gradient and the recrystallized grains tend to grow along the axis of gradient motion. The earliest use of type of process appears to have been in the electric lamp industry for the preparation of tungsten filament material. British patent 174,714 (1922) describes the application of the process. A further description of this process is contained in the book "Tungsten" by C. J. Smithells, Chemical Publishing Co., especially pages 143 through 146. Apart from use in the preparation of electric lamp filaments this type of process has been widely used as a metallurgical technique for the production of single crystals. This aspect is reviewed in the book "The Art and Science of Growing Crystals" edited by J. J. Gilman, John Wiley Publ. Co., (1964) pages 415 through 479. A mathematical model of the process has been developed by Williamson and Smallman in *Acta Metallurgica*, Vol. 1, pages 487–491 (1953). Additional references which bear on this subject include "Crystal Growth in Metals" by G. R. Fonda in *General Electric Review*, Volume 25, May 1922, pages 305–315; and "Ueber die Umkristallisation von Elektrolyteisen" by G. Wasserman in *Mitt. K. W. Inst. Eisenf. Dusseldorf*, Volume 17, 1935, page 203.

Extensive use of this type of process has been made for the production of special magnetic materials, see for example U.S. Pat. No. 3,219,496, and an article by Dunn and Nonken in Metal Progress, December 1953, pages 71–75.

More recent references to this type of process include U.S. Pat. Nos. 3,850,702, 3,746,581 and 3,772,090.

U.S. Pat. No. 3,850,702 describes a process applicable to the gamma/gamma prime alloys in which the alloy is heat treated to produce an all gamma structure prior to straining. The straining step is performed at relatively low temperatures and reprecipitation of the gamma phase occurs during annealing. Both U.S. Pat. Nos. 3,746,581 and 3,772,090 are processes applicable chiefly to dispersion strengthened alloys. In U.S. Pat. No. 3,772,090 the strain is imparted at low temperatures, while in U.S. Pat. No. 3,746,581 the strain is imparted by hot extrusion under controlled conditions.

The commercial use of the strain anneal process has heretofore been limited to simple shapes of constant cross section since it has hertofore not been possible to uniformly strain articles of varying cross section. Hence the process has been restricted to shapes such as wires, rods, bars and strips. One possible exception to this statement is found in U.S. Pat. No. 3,772,090 which states that a turbine blade shape was recrystallized using a moving gradient process. No details of the deformation process are given and it is not clear how a uniform dislocation density could be generated in such a structure by the processes discussed in the patent. It seems possible that the shape was that of a constant cross section airfoil without the root portion which must be present for practical application.

Another reference which appears pertinent to the present invention is U.S. Pat. No. 3,519,503, assigned to the present assignee. This patent discloses an isothermal forging technique which is applied to superalloys which have been rendered temporarily super-plastic by an appropriate prior thermomechanical conditioning treatment.

SUMMARY OF THE INVENTION

This invention deals with the method for producing an anistropic microstructure containing elongated grains in nickel base superalloys of the gamma/gamma prime type. The grains in the final product will typically have an aspect ratio (ratio of length to diameter) of at least about 10:1.

The process of the present invention is applicable to nickel base superalloys of the gamma/gamma prime type which have been placed in a temporary condition of super-plasticity. This super-plastic material is deformed by isothermal hot deformation under critical conditions of strain rate, total strain, and temperature, so as to produce a particular uniform dislocation density, and a concurrent propensity for abnormal grain growth. The material is then recrystallized by progressively heating the article by using a steep thermal gradient which moves relative to the workpiece. The hot end of the thermal gradient excedes the gamma prime solvus temperature so that the gamma prime particles (which normally inhibit grain growth) dissolve. Once nucleated, a single grain can grow for long distances. Thus producing the desired recrystallized wrought structure. The resultant structure has anisotropic elevated temperature properties, with maximum properties obtained in the direction of grain elongation, and is particularly useful for highly stressed parts which will be used at elevated temperatures. In one embodiment of the process, an optional method of generating a temporary condition of super-plasticity in nickel base superalloys is described.

The foregoing, and other objects, features and advantages of the present invention will become more apparent in the light of the following detailed description of the preferred embodiment thereof as shown in the accompanying drawing.

DESCRIPTION OF THE PREFERED EMBODIMENT

Figure 1:
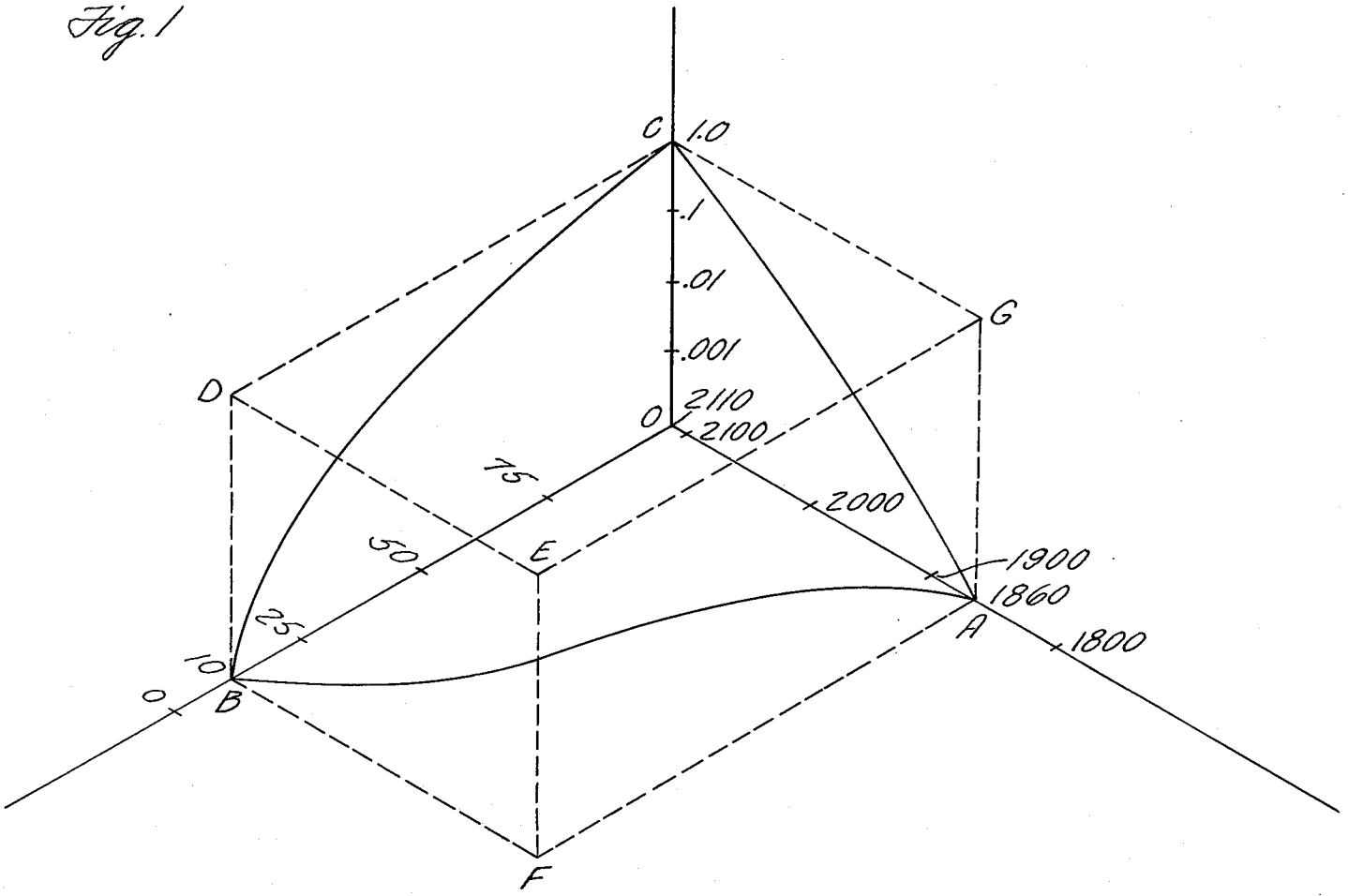
FIG. 1 shows a plot of preferred forging conditions for alloy AF2-1DA.

While techniques involving recrystallization of deformed metal objects in thermal gradients are well known and have been used for at least 60 years, virtually all of the prior art has been directed at processes which are restricted to articles having a constant cross-sectional area along a particular axis. These processes rely on deformation in the low to moderate temperature range and the required uniform dislocation density can only be achieved in a workpiece with uniform cross section. In the prior art, deformation has usually been performed by applying a tensile stress. The generation of uniform strain requires a uniform cross-sectional area perpendicular to the stress axis. Another common feature of the prior art is their application to alloys with simple chemical composition and unvarying phase relationships. One large group of the prior art applies only to single phase alloys, such as pure metals. Another group of the prior art relates to two phase alloys wherein the second phase is essentially insoluble in the alloy, such as dispersion strengthened materials. None of the prior art makes practical use of the dissolution of a second phase in the matrix at elevated temperatures as a method of grain growth control.

The process of the present invention is primarily applicable to the nickel base superalloys of the gamma/gamma prime type. These alloys consist of a gamma matrix containing particles of gamma prime which serve to improve the mechanical properties. It is characteristic of these alloys that the gamma prime phase dissolves into the gamma matrix above a certain temperature, termed the gamma prime solvus temperature.

The present invention includes a thermomechanical treatment for generating uniform dislocation densities in super-plastic superalloy metal articles having complex chemical compositions as well as complex geometrical shapes so that such articles may be recrystallized in a moving thermal gradient to produce structures with elongated grains. The recrystallized grains will typically have an aspect ratio (ratio of length to diameter) of at least 10:1 and an average grain diameter of at least 0.050 in. The present invention is particularly suited to the gamma/gamma prime type of nickel base superalloys. Articles may be produced having a configuration of a gas turbine blade or vane, or other high temperature articles such as a combination disc-blade assembly for gas turbine engines. The final structure consists of elongated grains which have resulted from the directional recrystallization of wrought material.

A first criteria for the successful application of the present invention is that the starting material must be super-plastic. Consistent super-plasticity has been obtained in materials prepared by powder metallurgy techniques. These techniques involve the formation of metal powders of the desired composition with the particle size of the powders being on the order of 100 mesh and the compaction of these powders at elevated temperatures to form the desired starting shapes. Experiments to date with cast material have not been completely successful and this lack of success is attributed to the inhomogenity which is characteristic of the cast superalloys. Accordingly it is preferred that the starting material be prepared by powder metallurgy techniques. One preferred technique is as follows: the initial step is to provide the desired material in the form of clean powder. This powder is then compacted at elevated temperatures, usually within about 300°F of the gamma prime solvus, and high compaction pressures, usually in excess of about 100,000 psi, usually in a vacuum. Following this step, the compacted powder is conditioned by an amount of hot deformation equal to about a 4:1 area reduction at a temperature below but within 450°F of the gamma prime solvus temperature. The effect of this deformation is to place the compacted powder article in a condition of temporary super-plasticity with a grain size of less than about 35 microns. A preferred deformation technique is hot extrusion. While the preceding procedure is one which consistently developes a super-plastic condition, any procedure which produces an equivalent condition of super-plasticity could be utilized.

The homogeneous super-plastic material is then hot deformed to the desired final article configuration under controlled isothermal conditions, to produce a uniform dislocation density. Any apparatus which contacts the super-plastic material, such as dies, etc., must be heated to the deformation temperature. Nonuniform reductions may occur in the hot deformation operation so that complex final shapes may be produced from simple starting shapes with the final product still containing a uniform dislocation density. The hot deformation parameters which are critical include deformation temperature, deformation rate and the total amount of deformation. The hot deformation step is performed under essentially isothermal conditions using apparatus in which all parts which contact the workpiece have been preheated to the hot deformation temperature. The deformation temperature must be below the gamma prime solvus temperature of the starting material but within about 250°F of the gamma prime solvus. The deformation rate during the hot deformation step is critical to the proper application of the invention and must be below about 1.0 inches per inch per inch per minute. Deformation rates above this rate lead to excessive nonuniform dislocation densities in the finished product which can cause equiaxed grain growth. The total deformation amount applied during the hot deformation step is also important in achieving the desired final structure. The total deformation amount must be in excess of about 10 percent. Typical useful deformation processes include compressive procedures such as forging, rolling, and extrusion. Following the hot working step the alloy is cooled to room temperature and the material wil preferably have a dislocation density of from about $5\times10^7$ to about $5\times10^8/cm^2$. Dislocation densities above this range can lead to the nucleation and growth of equiaxed grains while dislocation densities below this range may not be sufficient to cause recrystallization.

Figure 2:
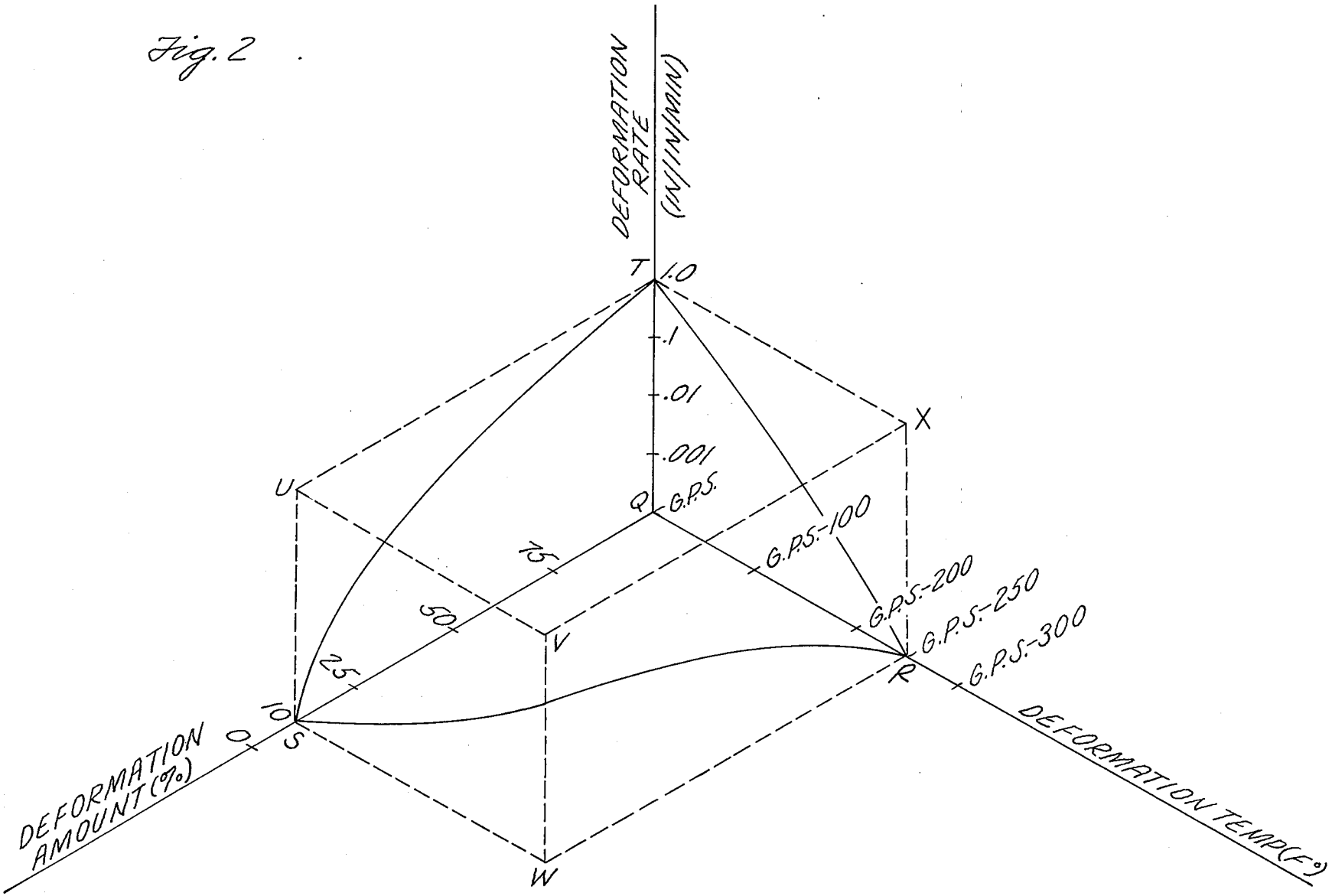
FIG. 2 shows a plot of preferred forging conditions for the gamma/gamma prime nickel base superalloys.

Within the specified range of dislocation densities, the alloy will usually exhibit a propensity for abnormal grain growth. However, even within the hot deformation parameter limits set forth above not all combinatiions of deformation temperatures, deformation rate and deformation amounts, give consistently good results. FIG. 1 is a diagram which gives a particularly preferred range of combinations of these three hot deformation parameters. The data in FIG. 1 was developed from data generated using the nickel base superalloy AF2-1DA, the composition of which is detailed in Table I, but tests run on other nickel base superalloy confirm its generality. A similar generalized diagram is shown in FIG. 2 and the hot deformation conditions set forth in this diagram are believed broadly applicable to the class of the gamma/gamma prime nickel base superalloys in which the gamma prime solvus temperature is less than the bulk melting temperatures of the alloy. In FIG. 1, the broad range is bounded by the line segments O—A, O—B, O—C, G—A, G—C, G—E, D—C, D—B, D—E, F—A, F—E, and F—B. The preferred range is bounded by the line segments O—A, O—B, O—C, C—B, C—A and A—B. In FIG. 2, the broad range is bounded by the line segments Q—R, Q—S, Q—T, X—R, X—T, X—V, U—T, U—S, U—V, W—R, W—S and W—V. The preferred range is bounded by the line segments Q—T, Q—R, Q—S, T—S, T—R, and S—R.

Hot deformation parameter combinations within the broad ranges indicated above, but outside of the preferred combinations indicated in FIG. 1 tend to give excessive dislocation densities However, these dislocation densities are uniform and this uniformity seems to be a normal result of hot die isothermal forging in the range of conditions indicated. This sugggests that parts forged outside of the preferred range, but within the broad range might be given a recovery heat treatment to reduce the dislocation content to the preferred range. Such a treatment would typically be performed at a temperature below, but within 450°F of the gamma prime solvus for a time of up to 24 hours. The time and temperature are inversely related and must be experimentally determined for each alloy and alloy condition.

Following the hot deformation step, which has placed the material in a condition of uniform controlled dislocation density, the material is recrystallized by passage relative to a thermal gradient so as to induce the growth of elongated grains. The hot end of the thermal gradient must excede the gamma prime solvus temperature. The thermal gradient should have a slope of at least about 50°F per inch measured at the gamma prime solvus temperature and preferably at least about 100°F/inch. The rate of motion of the thermal gradient will be less than about 2 in/hr. Grain growth occurs in metals only after a particular temperature has been exceded. Thus, grain growth in a portion of the article occurs only after heating of the portion in the hot end of the gradient. Passage relative to a thermal gradient constitutes progressive heating along the axis of relative gradient motion. Grain growth occurs along the axis of thermal gradient motion, and the direction of grain elongation is perpendicular to the thermal gradient. If the thermal gradient is planar, all the elongated grain will have parallel axes of elongation. If, however, a curved thermal gradient is used the resultant article will contain non-parallel elongated grains. The hot end of the thermal gradient must excede the gamma prime solvus temperature but obviously cannot excede the solidus temperature of the material. The gamma prime solvus must be exceded so that dissolution of the gamma prime particles will occur. If this dissolution does not occur, grain growth will not occur. One limiting factor for the gradient travel rate may be the dissolution rate of the gamma prime particles. The gamma prime particles will reprecipitate during cooling or subsequent exposure to elevated temperatures below the gamma prime solvus. The reprecipitated gamma prime particles will aid in preventing subsequent grain growth.

Under certain circumstances, the steepness of the thermal gradient will influence the maximum rate of gradient motion which will yield satisfactory results. Steeper gradients will permit faster rates of gradient travel. Also, a steeper thermal gradient will produce a more uniform elongated grain microstructure in those materials which have been hot deformed near the limits set forth above for deformation temperature, total deformation and deformation rate.

The process of the present invention is particularly suited for the fabrication of complex shapes from high temperature nickel base superalloys. The process of the present invention may easily be applied to complex shapes having nonuniform cross sections namely those which have cross-sectional areas which vary by a factor of at least 2:1. As previously noted, such non-simple shapes may be produced by the hot deformation step. The prior art processes have not disclosed techniques for producing uniform dislocation densities in such complex shapes. The production of a uniform structure of elongated grains require a uniform dislocation density. The ability of the present process to produce uniform dislocation densities in complex shapes is not completely understood but is believed to be related to the isothermal nature of the forging step.

The resultant recrystallized structures will be composed of elongated grain having a length to diameter ratio of at least about 10:1 and preferably at least about 20:1. The minimum grain diameter will be on the order of 0.050 inches. The recrystallized structure will be characeterized by being wrought rather than cast, that is to say there will be no dendritic structure or other characteristics of cast structures present in the product of the present process. The process of the present invention may be better understood through reference to the following illustrative examples.

Example I

A starting billet was prepared frm Argon atomized AF2-1DA superalloy powder having a −100 mesh size. This material has a gamma prime solvus temperature of about 2110°F. The composition of this alloy is given in Table I. The loose powder was encapsulated in a 6.00 in. O.D. × 0.250-in. wall stainless steel container utilizing an inert atmosphere processing technique. The container was then evacuated to 1 micron internal pressure and sealed. The sealed capsule was then heated to 2000°F, held for 8 hours at temperature, and consolidated by hot compaction under a pressure of 160,000 psi for 6 seconds. The billet was then cooled to 1000°F at a rate of 100°F/hr in a salt bath to minimize possible cracking, and then air cooled to room temperature. Subsequently, the billet was heated to 2025°F, and held at that temperature for four hours and then extruded through a 2.66 inch die. A plain carbon steel nose plug, heated to 1300°F, was placed in front of the billets in the extrusion press chamber to increase breakthrough pressure and hence, aid in consolidation. The reduction ratio in this extrusion process was 5.3:1.

The hot deformation step was performed by forging using heated dies. Forging blanks 2.2 in. diameter by 3.0 in. long were machined form this extrusion and reduced to 0.50 in. thick flat disk configurations (a reduction in height of 83%) by isothermal forging at a temperature of 2050°F and a deformation rate of 0.10 in/in/min. The forging reduction in this, and subsequent examples was conducted on a forging press that could be programmed to produce a constant strain rate rather than the more usual constant cross head speed. Slices, 0.50 in. × 0.50 in. × 2.50 long were then cut from these forgings and subjected to a temperature gradient of approximately 100°F/in at 2110°F which moved at rates ranging form 2.0 down to 0.25 in/hr. Metallographic evaluation revealed a fully directional grain structure with aspect ratios much greater than 10:1 in the samples exposed at rates equal to 0.50 in/hr or slower. At a rate of 1.0 in/hr, discontinuous grain growth was

TABLE I

| | Nominal Alloy Compositions (W/O) | | |
|---|---|---|---|
| | AF2-1DA | MAR-M200 | IN100 MOD |
| C | 0.30–0.35 | 0.12–0.17 | 0.05–0.09 |
| S | 0.05 Max | 0.015 Max | 0.010 Max |
| Co | 9.5–10.5 | 9.00–11.00 | 18.0–19.0 |
| Cr | 11.5–12.5 | 8.00–10.00 | 11.9–12.9 |
| Al | 4.2–4.8 | 4.75–5.25 | 4.8–5.15 |
| Ti | 2.75–3.25 | 1.75–2.25 | 4.15–4.50 |
| Mo | 2.5–3.5 | — | 2.80–3.60 |
| W | 5.5–6.5 | 11.50–13.50 | — |
| Ta | 1.0–2.0 | — | — |
| Si | 0.10 Max | 0.20 Max | 0.10 Max |
| Fe | 0.50 Max | 1.5 Max | 0.30 Max |
| B | 0.01–0.02 | 0.01–0102 | 0.016–0.024 |
| Zr | 0.05–0.15 | 0.03–0.08 | 0.04–0.08 |
| $O_2$ | 100 ppm Max | 100 ppm Max | 100 ppm Max |
| Ni | Bal | Bal | Bal |
| V | — | — | 0.58–0.98 |
| Cb | — | 0.75–1.25 | — |

noted with grain aspect ratios of 4:1 or less. At a rate of 2.0 in/hr, a coarse grained equiaxed grain structure was developed. This example demonstrates the critical effect of the rate of gradient travel.

Example II

Figure 3:
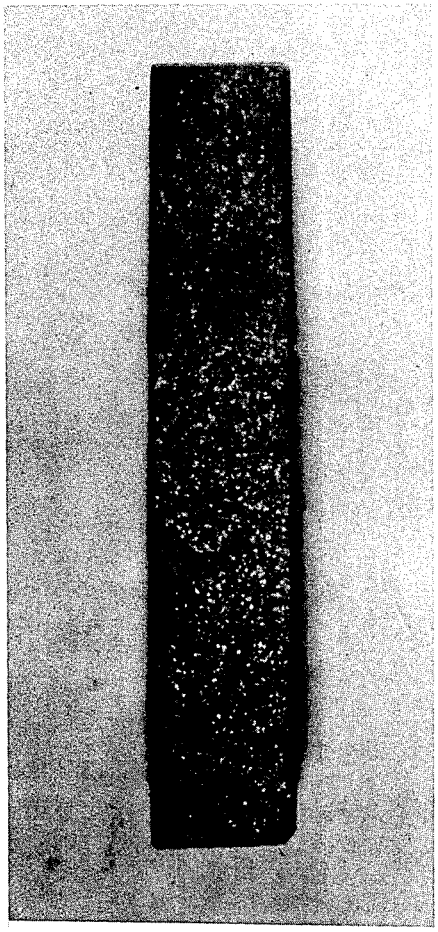
FIG. 3 shows the macrostructure of Alloy AF2-1DA, forged outside of the preferred range, after recrystallization in a thermal gradient.
Figure 4:
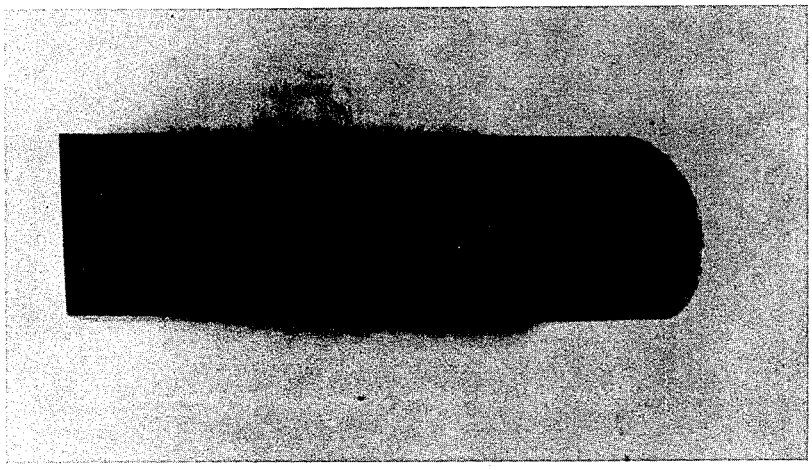
FIG. 4 shows the macrostructure of alloy Af2-1DA, forged within the preferred range, after partial recrystallization in a thermal gradient.

Three AF2-1DA superalloy forging blanks were prepared using the same technique as detailed in Example I. Utilizing a compressive isothermal forging technique at a temperature of 1950°F, these blanks were reduced 83% in height, at deformation rates of 0.50, 0.10 and 0.01 in/in/min respectively. Samples cut from these three forgings were subjected to a gradient of 100°F/in at 2110°F which moved at a rate of approximately 0.50 in/hr. The sample from the disk forged at a rate of 0.50 in/in/min was found to have a fine grained equiaxed microstructure. The sample from the disk forged at 0.10 in/in/min was found to have a coarse grained (ASTM 1-0) microstructure. A 2× macrophotograph of the 0.1 in/in/min sample is shown in FIG. 3. The sample forged at 0.01 in/in/min had a fully directional microstructure with a grain aspect ratio greater than 10:1. A 2× macrophotograph of the 0.01 in/in/min sample is shown in FIG. 4, which shows the sample after a partial thermal gradient traverse. This example demonstrates the effect of the hot deformation rate.

Example III

Three AF2-1DA disk forgings were prepared by the same technique as described in Example I except that the deformation temperature was raised to 2050°F, and the total reduction in height was reduced to 50%. Samples from all three forgings (one forged at a strain rate of 0.50 in/in/min, one forged at a strain rate of 0.10 in/in/min, and one forged at a strain rate of 0.01 in/in/-min) exhibited fully developed directional growth upon exposure to a 100°F/in temperature gradient which moved at a rate of ½ in/hr. However, a tendency toward the nucleation of secondary grains was noted with increasing deformation rate. This example indicates the effect of deformation temperature.

Example IV

Eight AF2-1DA forging blanks were prepared by the technique described in Example I. These blanks were reduced to disk configurations at a temperature of 2050°F and at a deformation rate of 0.10 in/in/min with total reductions in height of 9, 16, 30, 45, 50, 60, 67 and 75 percent respectively. Samples from these disks were then exposed to a thermal gradient of 100°F/in at 2110°F which moved at a rate of 0.5 in/hr. The sample reduced 9 percent exhibited a fine grained equiaxed microstructure. The grain size increased with total reduction up to 30 percent. The 45 percent reduction sample exhibited low aspect ratio directional growth. Aspect ratio thereafter increased with increasing reduction. This example demonstrates the effect of total deformation amount.

Example V

Three forging blanks of AF2-1DA alloy were prepared by the method described in Example I. These three blanks were then reduced 30 percent in height at 2050°F at deformation rates of 0.01, 0.10, and 0.50 in/in/min. Samples cut from the resultant disk forgings were then exposed to a moving gradient of 100°F/in at 2110°F at a rate of 0.5 in/hr. The sample deformed at a rate of 0.01 in/in/hr was found to be fully directional with an aspect ratio of greater than 10:1. The sample deformed at a rate of 0.10 in/in/hr was coarse grained and equiaxed. The sample deformed at a rate of 0.50 in/in/min was found to be fine grained and equiaxed.

This example demonstrates the effect of deformation rate.

Example VI

Four forging blanks of alloy Af2-1DA were prepared by the method described in Example I. These blanks were then reduced at a deformation rate of 0.10 in-/in/hr to a total reduction of 83 percent at temperatures of 1950°, 2000°, 2050°, and 2075°F using heated dies. Samples cut from each of the resultant disks were exposed to a moving gradient of 100°F/in at 2110°F at a rate of 0.5 in/hr. The sample forged at 1950°F was found to possess a medium grain size (ASTM 1-2) equiaxed structure. The sample forged at 2000°F exhibited discontinuous directional growth with grain aspect ratios of approximately 3:1. The samples forged at 2050°F and 2075°F exhibited fully developed directional grain structures with grain aspect ratios in excess of 10:1. This example demonstrates the effect of deformation temperature.

Example VII

Forging blanks of superalloy MAR-M200 were prepared by the method described in Example I. This alloy has a gamma prime solvus of about 2160°F and the nominal composition of this alloy is given in Table I. The forging step was performed at 2100°F at a deformation rate of 0.08 in/in/min to a total reduction in height of 83 percent. Samples cut from these forgings were exposed at a rate of 0.25 in/hr to moving gradients of 100°F/in, 400°F/in, and 800°F/in at 2150°F. Metallographic evaluation of the samples exposed to the 100°F/in gradient were found to be coarse grained (ASTM 1-2) and equiaxed. Samples exposed to the 400°F/in gradient exhibited a fully developed directional grain structure, but the microstructure was dotted with secondary equiaxed grains. Samples exposed to the 800°F/in gradient were found to be fully directional and free of secondary grains. This example demonstrates the importance of the steepness of the thermal gradient when attempting to directionally recrystallize material forged under marginal conditions.

Example VIII

Following the procedure described in Example I, several 0.500 × 0.250 × 2.0 inch samples of directionally recrystallized alloy AF2-1DA were produced using isothermal forging conditions of 83% reduction, 0.1 in/in/min strain rate, and 2050°F deformation temperature. These samples were subsequently subjected to the following heat treatment; 8 hours at 1975°F followed by air cooling, then 1600°F for 12 hours followed by air cooling. Conventional smooth 0.125 in dia by 1.0 in long gage dimension stres rupture specimens were machined from these samples and then tested at elevated temperatures. The results of these tests are listed in Table II along with some comparative data for AF2-1DA processed by conventional powder techniques, and given an equivalent heat treatment.

TABLE II

| Temperature | Stress | 1% Creep Life (hrs) | Rupture Elongation | Final |
|---|---|---|---|---|
| *1800°F | 29 ksi | 16.1 | 42.3 | 13.1 |
| **1800°F | 29 ksi | — | 13.0 | — |
| *1600 | 52 ksi | 35.2 | 105.3 | 12.9 |

TABLE II-continued

| Temperature | Stress | 1% Creep Life (hrs) | Rupture Elongation | Final |
|---|---|---|---|---|
| **1600°F | 52 ksi | — | 60.0 | — |

*Process of this invention
**Conventional Process

The test properties of the material produced by the present process can be seen to be superior to the test properties of the conventionally processed material.

EXample IX

Following the procedure of Example VI, samples of alloy MAR-M200 were exposed at a rate of ¼ in/hr to a gradient of 800°F/in at 2160°F. These samples were subsequently heat treated under conditions set forth below to further improve properties: 2 hours at 2200°F followed by air cooling, 4 hours at 1975°F followed by air cooling, 32 hours at 1600°F followed by air cooling. These samples were then tested at 1800°F and the results are listed in Table III along with some comparative data for conventionally processed (cast) MAR-M200 which was given an equivalent heat treatment.

TABLE III

| Temperature | Stress | Rupture Life (hrs) |
|---|---|---|
| *1800°F | 31.5 ksi | 55.4 |
| **1800°F | 31.5 ksi | 23.0 |

*Present invention process
**Conventional Process

Example X

Two (2) right circular cylindrical blanks of alloy AF2-1DA were prepared by the method described in Example I. These blanks were then hot extruded to the external configuration of an advanced air cooled gas turbine blade utilizing the following isothermal forging parameters, a temperature of 2075°F, a deformation rate of about 0.05 in/in/min, and a total reduction in initial height of about 80 percent. The internal configuration of the blade was then established by electrochemically machining in from the convex and concave sides of the two forgings, respectively. These two blades halves were then chemically cleaned to remove forging lubricants, machining residues, etc. and deformation assisted diffusion bonded together to produce a hollow, forged simulated turbine assembly. The bonding was accomplished isothermally at 2075°F using a deformation rate of 0.05 in/in/min, and a total reduction in height of 10 percent (the total deformation in the two steps was about 82%).

The bonded blade was then passed through an induction heated cylindrical graphite susceptor at a rate of ½ in/hr. At the entrance to the susceptor, a thermal gradient of 250°F/in was measured at 2110°F.

Figure 5:
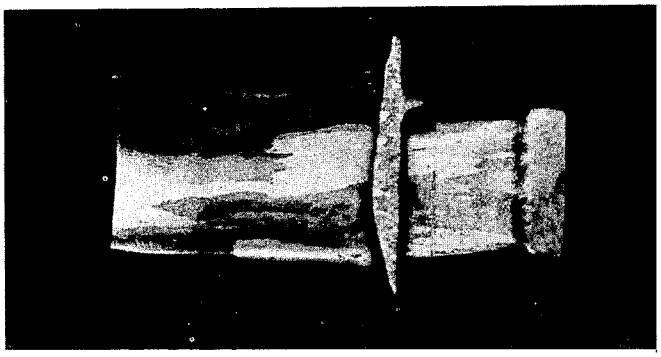
FIG. 5 shows a macrophotograph of a blade, produced according to the present invention, showing an elongated grain structure.

Metallographic evaluation revealed that the heat treated blade possessed a fully directional microstructure with grain aspect ratios typically of 10:1 and greater. Macroscopic views of the final blade are shown in FIG. 5. This example demonstrates the ability of the present process to produce complex final shapes from simple starting shapes, and the ability of the process to produce elongated recrystallized grains in articles having varying cross sections.

Example XI

A forging blank of alloy AF2-1DA was prepared as described in Example I. This blank was reduced to a 0.50 in. thick × 6.50 in. dia. flat disk at 2075°F at a deformation rate of 0.08 in/in/min and a total reduction in height of 85 percent. A circular hole 0.875 in/in dia. was bored through the center of the disk. A series of 1.0 in. long by 0.125 in. thick strips were then machined on the periphery of the disk radially to produce a simulated integrally bladed turbine wheel.

An interference fit water cooled copper tube was then inserted axially through the center hole of the disk. The assembly was placed in the center of a 9.0 in. O.D. × 7.0 in. ID × 2.0 in. high graphite susceptor such that the axis of the cooling tube corresponded with the axis of the susceptor and the center plane of the disk coincided with the center plane of the susceptor. The susceptor, which was wrapped with a four turn water cooled copper induction coil, was then heated at a rate of 200°F/hr from 2300° to 2700°F. This rise in susceptor temperature induced, by radiant heating, a moving temperature gradient of approximately 100°F/in at 2110°F to proceed from the simulated blade tips to the roots at a rate approximately 0.50 in/hr.

Figure 6B:
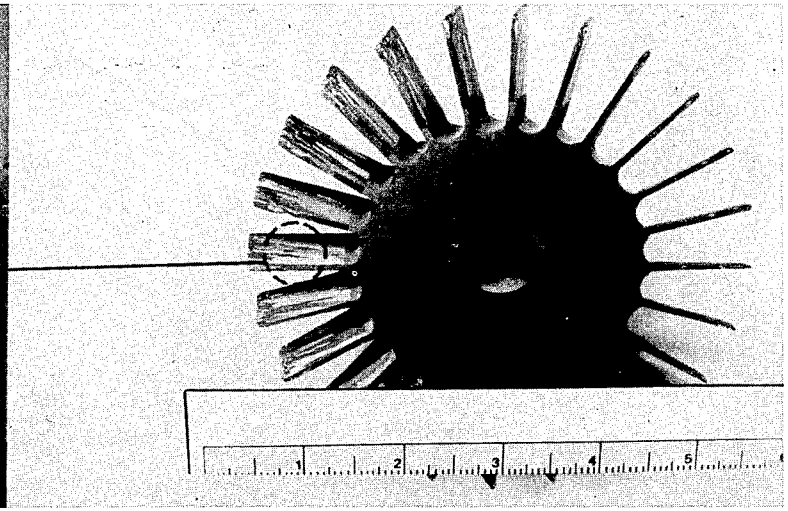
FIGS. 6A and 6B show macrophotographs of an integral blade-disc, produced according to the present invention, showing a radial structure of elongated grains.
Figure 6A:
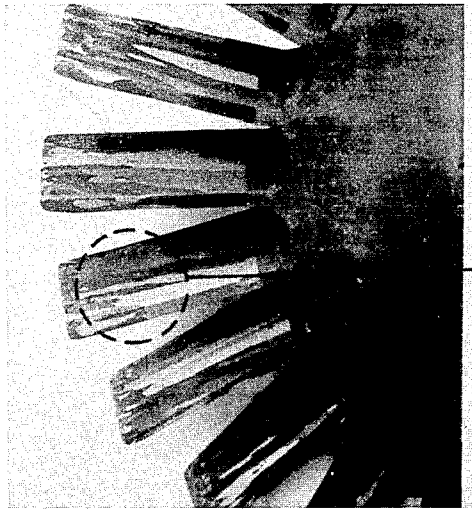

Metallographic evaluation revealed that the simulated blades contained a fully developed high aspect ratio directional grain structure. The disk, however, was found to possess a fine grained equiaxed structure typical of the as forged material. A discrete concentric ring, representing the final position of the 2110°F isotherm, separated the two microstructures. Macroscopic photographs of the final product are shown in FIGS. 6A and 6B. This example demonstrates the possibility of using a non-planar thermal gradient to produce a microstructure containing non-parallel elongated grains. An expanding thermal gradient, which moved in a radial fashion, produced a radial arrangement of elongated grains.

Example XII

An extrusion capsule containing In100 Mod alloy powder of the composition shown in Table I was prepared by the method of Example I, except that the extrusion can was 18.5 in. in dia. Hot compaction was accomplished at 1850°F after a presoak period of 45 hours. Billet extrusion was accomplished at 1950°F after an 8 hour presoak. The die orifice was 7.1 in. in dia. resulting in a net area reduction ratio by extrusion of approximately 6.8:1. A right cylindrical circular forging multiple, approximately 2.0 in. in dia. by 2.0 in. high, was cut from the extrusion and was isothermally forged to flat pancake configurations at 2100°F using a deformation rate of 0.05 in/in/min. with a total reduction in height of approximately 80 percent.

Figure 7:
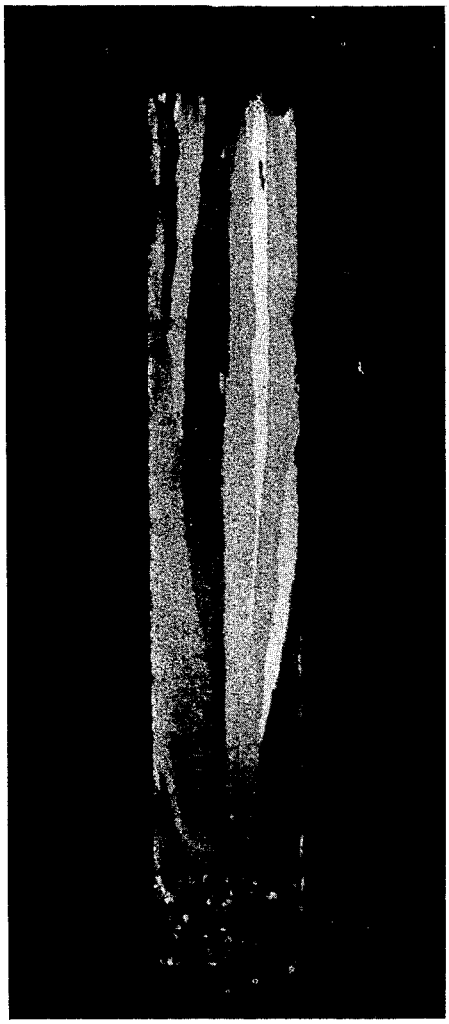
FIG. 7 shows the macrostructure of alloy IN100 Mod, forged within the preferred range, after recrystallization in a thermal gradient.

A slice approximately 2.5 in. long × 0.875 in. wide × 0.500 in. thick was then cut from the pancake and exposed to a moving temperature gradient of approximately 800°F/in at 2140°F at a rate of ¼ in/hr. Subsequent metallographic evaluation revealed a fully developed directional grain structure with grain aspect ratios of 10:1 and greater. A 2× microphotograh of this sample after a partial thermal gradient traverse is shown in FIG. 7.

This material was then subjected to the following heat treatment:

2175/1/Ac — 2 hours at 2175°F followed by air cooling,

+1975/1/AC — 2 hours at 1975°F followed by air cooling, and

+1600/32/AC — 32 hours at 1600°f followed by air cooling.

Stress rupture specimens were machined from these samples and tested. The results of these tests are listed in Table IV along with some comparative data for IN100 Mod processed by conventional techniques.

TABLE IV

| Temperature | Stress | 1% Creep Life (hrs) | Rupture Life (hrs) | Final Elongation (%) |
|---|---|---|---|---|
| *1800 | 29 | 24.0 | 36.2 | 22.8 |
| *1800 | 29 | 28.5 | 42.9 | 9.9 |
| **1800 | 29 | 5.3 | 21.0 | 14.8 |
| **1800 | 29 | 5.7 | 21.5 | 6.3 |

*Method of this process
**Conventional processing

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of our invention that which we claim as new and desire to secure by Letters Patent of the United States is:

1. A thermomechanical process for producing a microstructure of elongated grains in nickel base superalloys, which possess a gamma prime second phase and a gamma prime solvus temperature, including the steps of:

a. providing the nickel base superalloy in a superplastic condition;

b. hot deforming the superalloy under the following conditions: a deformation temperature below but within about 250°F of the gamma prime solvus, a deformation rate of less than about 1.0 in/in/min, and a total deformation amount in excess of about 10%;

c. progressively heating the article in a thermal gradient which moves relative to the article with the thermal gradient having a steepness of at least 50°F/in measured at the gamma prime solvus temperature, and a hot end temperature greater than the gamma prime solvus temperature but less than the melting temperature.

2. A process as in claim 1 wherein the hot deformation conditions fall within the region bounded by the line segments Q—T, Q—R, Q—S, S—R, S—T, and T—R in FIG. 2.

3. A thermomechanical process for producing a microstructure of elongated grains in nickel base superalloys, which possess a gamma prime second phase and a gamma prime solvus temperature, including the steps of:

a. providing a mass of powder of the superalloy;

b. hot compacting the powder;

c. placing the compacted powder in a temporary condition of super-plasticity by hot working an amount equal to about a 4:1 area reduction at a temperature below, but within 450°F of the gamma prime solvus;

d. hot deforming the super-plastic superalloy under the following conditons: a temperature below but within about 250°F of the gamma prime solvus, a deformation rate of less than about 1.0 in/in/min, and a total deformation amount in excess of about 10%, whereby a uniform dislocation density and a propensity for abnormal grain growth results;

e. progressively heating the article in a thermal gradient which moves relative to the article, with the thermal gradient having steepness of at least about 50°F/in measured at the gamma prime solvus temperature, and a hot end temperature greater than the gamma prime solvus temperature but less than the melting temperature.

4. A thermomechanical process for producing a complex nickel base superalloy article having a cross-sectional area which varies by a factor of at least 2:1 and also having a microstructure of elongated grains which include the steps of:

a. providing the nickel base superalloy in a superplastic condition;

b. hot deforming the superalloy to a complex shape under the following conditions: a temperature below but within about 250°F of the gamma prime solvus, a deformation rate of less than about 1.0 in/in/min, and a total deformation amount in excess of about 10%;

c. progressively heating the shaped article in a thermal gradient which moves relative to the article with the thermal gradient having a steepness of at least 50°F/in measured at the gamma prime solvus temperature, and a hot end temperature greater than the gamma prime solvus temperature but less than the melting temperature.

* * * * *

UNITED STATES PATENT OFFICE

CERTIFICATE OF CORRECTION

PATENT NO. : 3,975,219

DATED : August 17, 1976

INVENTOR(S) : MARVIN MARTIN ALLEN, JOHN ALOIS MILLER and BRUCE EDWARD WOODINGS

It is certified that error appears in the above-identified patent and that said Letters Patent are hereby corrected as shown below:

| | |
|---|---|
| Column 1, line 34 | "maaterial" should read --material-- |
| Column 3, line 26 | "Af2-1DA" should read --AF2-1DA-- |
| Column 5, line 53 | "Fig. 1" should read --Fig. 2-- |
| Column 6, line 60 | "structures" should read --structure-- |
| Column 7, line 5 | "frm" should read --from-- |
| Column 9, line 5 | "Af2-1DA" should read --AF2-1DA-- |
| line 56 | "stres" should read --stress-- |
| Columns 9 and 10 | Table II, Headings for Columns 4 and 5 should read --Rupture Life (hrs)-- and --Final Elongation-- |
| Column 10, line 12 | "EXample" should be --Example-- |
| Column 13, line 6 | After "having" insert --a-- |

Signed and Sealed this

Fourth Day of January 1977

[SEAL]

*Attest:*

RUTH C. MASON
*Attesting Officer*

C. MARSHALL DANN
*Commissioner of Patents and Trademarks*